US006906022B1

(12) United States Patent
Capeci et al.

(10) Patent No.: US 6,906,022 B1
(45) Date of Patent: Jun. 14, 2005

(54) GRANULAR DETERGENT COMPOSITIONS HAVING HOMOGENOUS PARTICLES AND PROCESS FOR PRODUCING SAME

(75) Inventors: Scott William Capeci, North Bend, OH (US); Mark William Ridyard, Newcastle (GB); Paur R. Mort, III, Cincinnati, OH (US)

(73) Assignee: The Procter & Gamble Company, Cincinnati, OH (US)

( * ) Notice: Subject to any disclaimer, the term of this patent is extended or adjusted under 35 U.S.C. 154(b) by 0 days.

(21) Appl. No.: 09/787,452

(22) PCT Filed: Sep. 24, 1999

(86) PCT No.: PCT/US99/22395

§ 371 (c)(1),
(2), (4) Date: Jul. 13, 2001

(87) PCT Pub. No.: WO00/18877

PCT Pub. Date: Apr. 6, 2000

Related U.S. Application Data

(63) Continuation of application No. PCT/US98/20223, filed on Sep. 25, 1998.
(60) Provisional application No. 60/140,088, filed on Jun. 21, 1999.

(51) Int. Cl.[7] ..... C11D 17/00
(52) U.S. Cl. ..... 510/444; 510/438; 510/271; 510/452; 510/443

(58) Field of Search ..... 510/444, 438, 510/271, 452, 443

(56) References Cited

U.S. PATENT DOCUMENTS

| | | | | |
|---|---|---|---|---|
| 5,431,857 A | | 7/1995 | Capeci | 510/352 |
| 5,569,645 A | * | 10/1996 | Dinniwell et al. | 510/276 |
| 6,069,124 A | * | 5/2000 | Appel et al. | 510/438 |
| 6,191,095 B1 | * | 2/2001 | Emery et al. | 510/438 |

FOREIGN PATENT DOCUMENTS

| | | | |
|---|---|---|---|
| EP | 0816485 A1 | * | 1/1998 |
| GB | 2 317 393 A | | 3/1999 |
| WO | WO 92/07932 | | 5/1992 |
| WO | WO 97/10326 | | 3/1997 |
| WO | WO 98/35004 | | 8/1998 |
| WO | WO 99/36503 A1 | * | 7/1999 |

* cited by examiner

*Primary Examiner*—Charles Boyer
(74) *Attorney, Agent, or Firm*—Julia A. Glazer; Brian M. Bolam; Brahm J. Corstanje

(57) ABSTRACT

A detergent composition which has improved solubility or dissolution in laundering solutions, especially in solutions kept at cold temperatures (i.e., less than about 30° C.), is provided. The granular detergent composition is aesthetically pleasing to consumers and has improved flowability. The granular detergent composition has a homogeneity number of greater than 1 wherein the homogeneity number is defined by the equation $HN=X_{bulk}/X_{part}$. A process for producing the detergent is also provided.

6 Claims, No Drawings

GRANULAR DETERGENT COMPOSITIONS HAVING HOMOGENOUS PARTICLES AND PROCESS FOR PRODUCING SAME

This application is a 371 of PCT/US99/22395 filed Sep. 24, 1999 which is a continuation of PCT/US98/20223 filed Sep. 25, 1998 which claims the benefit of 60/140,088 filed Jun. 21, 1999.

FIELD OF THE INVENTION

The present invention relates to improved granular detergent compositions of homogeneous particles which have superior solubility, especially in cold temperature laundering solutions (i.e., less than about 30° C.), and excellent flowability.

BACKGROUND OF THE INVENTION

Recently, there has been considerable interest within the detergent industry for laundry detergents which have the convenience, aesthetics and solubility of liquid laundry detergent products, but retain the cleaning performance and cost of granular detergent products. The problems, however, associated with past granular detergent compositions with regard to aesthetics, solubility and user convenience are formidable. Such problems have been exacerbated by the advent of "compact" or low dosage granular detergent products which typically do not dissolve in washing solutions as well as their liquid laundry detergent counterparts. These low dosage detergents are currently in high demand as they conserve resources and can be sold in small packages which are more convenient for consumers prior to use, but less convenient upon dispensing into the washing machine as compared to liquid laundry detergent which can be simply poured directly from the bottle as opposed to "scooped" from the box and then dispensed into the washing solution.

As mentioned, such low dosage or "compact" detergent products unfortunately experience dissolution problems, especially in cold temperature laundering solutions (i.e., less than about 30° C.). More specifically, poor dissolution results in the formation of "clumps" which appear as solid white masses remaining in the washing machine or on the laundered clothes after conventional washing cycles. These "clumps" are especially prevalent under cold temperature washing conditions and/or when the order of addition to the washing machine is laundry detergent first, clothes second and water last (commonly known as the "Reverse Order Of Addition" or "ROOA"). Such undesirable "clumps" are also formed if the consumer loads the washing machine in the order of clothes, detergent and then water. Similarly, this clumping phenomenon can contribute to the incomplete dispensing of detergent in washing machines equipped with dispenser drawers or in other dispensing devices, such as a granulette. In this case, the undesired result is undissolved detergent residue in the dispensing device.

It has been found that the cause of the aforementioned dissolution problem is associated with the "bridging" of a "gel-like" substance between surfactant-containing particles to form undesirable "clumps." The gel-like substance responsible for the undesirable "bridging" of particles into "clumps" originates from the partial dissolution of surfactant in the aqueous laundering solutions, wherein such partial dissolution causes the formation of a highly viscous surfactant phase or paste which binds or otherwise "bridges" other surfactant-containing particles together into "clumps." This undesirable dissolution phenomena is commonly referred to as "lump-gel" formation. In addition to the viscous surfactant "bridging" effect, inorganic salts have a tendency to hydrate which can also cause "bridging" of particles which linked together via hydration. In particular, inorganic salts hydrate with one another to form a cage structure which exhibits poor dissolution and ultimately ends up as a "clump" after the washing cycle. It would therefore be desirable to have a detergent composition which does not experience the dissolution problems identified above so as to result in improved cleaning performance.

The prior art is replete with disclosures addressing the dissolution problems associated with granular detergent compositions. For example, the prior art suggests limiting the use and manner of inorganic salts which can cause clumps via the "bridging" of hydrated salts during the laundering cycle. Specific ratios of selected inorganic salts are contemplated so as to minimize dissolution problems. Such a solution, however, constricts the formulation and process flexibility which are necessary for current commercialization of large-scale detergent products. Various other mechanisms have been suggested by the prior art, all of which involve formulation alteration, and thereby reduce formulation flexibility. As a consequence, it would therefore be desirable to have a detergent composition having improved dissolution without significantly inhibiting formulation flexibility.

Accordingly, despite the disclosures in the prior art discussed previously, it would be desirable to have a granular detergent composition which exhibits improved solubility, has improved flowability and exhibits improved cleaning performance. Also, it would be desirable to have such a detergent composition which exhibits such improved dissolution without significantly inhibiting formulation flexibility.

SUMMARY OF THE INVENTION

The present invention meets the aformentioned needs by providing a detergent composition which has a controlled scale of heterogeneity between selected chemical ingredients which in turn provides the improved solubility or dissolution in laundering solutions, especially in solutions kept at cold temperatures (i.e. less than about 30° C.). and has improved flowabiiity of the as-packaged granules for ease of handling and scooping by the consumer.

In accordance with a first aspect of the present invention, a granular detergent composition is provided having a homogeneity number of less than about 0.5 or greater than about one (I) where the homogeneity number is defined by the formula:

$$HN=X_{bulk}/X_{part}$$

where $X_{bulk}$ is the ratio of the concentration of a selected detergent ingredient in the particulate admixture component containing the selected ingredient at the lowest concentration of any admixture particulate component to the concentration of the selected ingredient in the particulate admixture component with the highest levels of that ingredient and $X_{part}$ is the ratio of the concentration of a detergent ingredient in a discrete volume of a particle (referred to hereafter as a "domain") with the lowest levels of that ingredient to the concentration of the detergent ingredient in a separate discrete volume. (i.e., a domain) of the particle with the highest levels of the ingredient, of less than about 0.5 or greater than about 1. Preferably, the selected detergent ingredient upon which the homogeneity number is based is surfactant concentration. More preferably, the homogeneity number is greater than about 1.25 and most preferably greater than 1.5.

In preferred embodiments, the detergent composition comprises at least about 50% by weight of particles having a geometric mean particle diameter of from about 500 microns to about 1500 microns with a geometric standard deviation of from about 1 to about 2, wherein at least a portion of the particles contain a detersive surfactant and a detergent builder.

In accordance with a second aspect of the present invention, a process for producing the aformentioned detergent composition is provided. The process comprises providing a granular feed stream selected from detergent particles being selected from at least two of the group consisting of spray-dried granules, wet agglomerates, dry agglomerates, detergent adjunct ingredients and mixtures thereof, passing the feed stream through at least one mixer selected from high speed, moderate speed, low speed, and low shear mixers to produce a detergent composition.

Accordingly, it is an advantage of the invention to provide a granular detergent composition which exhibits improved solubility, has improved flowability and exhibits improved cleaning performance. It is also an advantage to have such a detergent composition which exhibits such improved dissolution without significantly inhibiting formulation flexibility.

DETAILED DESCRIPTION OF THE PREFERRED EMBODIMENT

Definitions

As used herein, the word "particles" means the entire size range of a detergent final product or component or the entire size range of discrete particles, agglomerates, or granules in a final detergent product or component admixture. It specifically does not refer to a size fraction (i.e., representing less than 100% of the entire size range) of any of these types of particles unless the size fraction represents 100% of a discrete particle in an admixture of particles. For each type of particle component in an admixture, i.e., for each particulate admixture component, the entire size range of discrete particles of that type have the same or substantially similar composition regardless of whether the particles are in contact with other particles. For agglomerated components, the agglomerates themselves are considered as discrete particles and each discrete particle may be comprised of a composite of smaller agglomerates, primary particles and binder compositions. As used herein, the phrase "geometric mean particle diameter" means the geometric mass median diameter of a set of discrete particles as measured by any standard mass-based particle size measurement technique, preferably by dry sieving. As used herein, the phrase "geometric standard deviation" or "span" of a particle size distribution means the geometric breadth of the best-fitted log-normal function to the above-mentioned particle size data which can be accomplished by the ratio of the diameter of the 84.13 percentile divided by the diameter of the $50^{th}$ percentile of the cumulative distribution ($D_{84.13}/D_{50}$); See Gotoh et al, *Powder Technology Handbook*, pp. 6–11, Meral Dekker 1997.

As used herein, the phrase "builder" means any inorganic material having "builder" performance in the detergency context, and specifically, organic or inorganic material capable of removing water hardness from washing solutions. As used herein, the term "bulk density" refers to the uncompressed, untapped powder bulk density, as measured by pouring an excess of powder sample through a funnel into a smooth metal vessel (e.g., a 500 ml volume cylinder), scraping off the excess from the heap above the rim of the vessel, measuring the remaining mass of powder and dividing the mass by the volume of the vessel.

The granular detergent composition of the present invention achieves the desired benefits of solubility, and flowability via providing a homogeneous detergent composition wherein the homogeneous detergent contributes to the aforementioned benefits.

The homogeneity number describes the distribution of ingredients within specific particles and between particles in a composition. In the past, it was believed that homogeneous distribution of key ingredients such as surfactant was optimal, as measured between particles as well as within a given particulate domain structure. Thus, detergent composition would consist of a uniform type of particle made up of a combination of detergent ingredients, such as spray-dried detergent ingredients and had significant solubility drawbacks. In recent years, detergent compositions have consisted of differing particles of dual or multi-particle systems. While these multi-particle systems, e.g. spray-dried granules and agglomerates, may differ in form and/or composition between particle types, these detergent products also experience solubility drawbacks.

The present invention, on the other hand, is directed toward the surprising discovery that specific distributions of ingredients, either between particulate admixture components or within a defined domain microstructure of a specific particulate component, improve many product attributes such as solubility and physical attributes such as flowability, etc. Specifically, the present invention is directed toward a detergent composition that has a homogeneity number of less than about 0.5 or greater than about 1.0, more preferably, either less than 0.25 or greater than 1.25 and most preferably greater than about 1.5. The homogeneity number is represented by the formula:

$HN=X_{bulk}/X_{part}$ where $X_{bulk}$ measures the degree of compositional homogeneity between particulate admixture components within the product composition, while $X_{part}$ is the measure of the compositional homogeneity within a defined domain structure of the individual particles comprising a specific particulate component. Thus, $X_{bulk}$ is the ratio of the concentration of the selected ingredient in the particle with the lowest non-zero level of that ingredient to the concentration of the selected ingredient in the particle with the highest level of the selected ingredient and $X_{part}$ is the ratio of the concentration in the discrete volume with the lowest amount of the selected ingredient to the concentration in the discrete volume of the particle having the highest amounts of the selected ingredient.

Accordingly, in a detergent composition, $X_{bulk}$ is the ratio of the concentration of a selected detergent ingredient such as surfactant, builder, polymer, etc. in particulate component with the lowest non-zero level of the selected ingredient to the concentration of the selected ingredient in the particulate component with the highest level of the selected ingredient. This provides the homogeneity between particles in the composition. Thus, $X_{bulk}$ is represent by the formula:

$$X_{bulk}=X_{min}/X_{max}$$

where $X_{min}$ is the concentration of the selected ingredient in the particles in the composition with the lowest levels of the selected ingredient and $X_{max}$ concentration of a selected detergent ingredient in the particles in the composition with the highest levels of the selected ingredient. For example, for a detergent composition in which all the particles have the same concentration such as a spray-dried granule with an active concentration of 25% surfactant, $X_{bulk}$ would be equal to one (I) or 0.25/0.25. However, in a composition which comprises a spray dried granule of 20% active surfactant and a detergent agglomerate of 30% detergent active $X_{bulk}$ would be equal to 0.67 or 0.2/0.3.

$X_{part}$ is the ratio of the concentration of a selected detergent ingredient such as surfactant, builder, etc. across domains within the same particle, or in other words a measure of the homogeneity of the individual particle. $X_{part}$ is the ratio of the selected ingredient in discrete domains of the particle. $X_{part}$ is the ratio of the concentration in the domain with the lowest concentration of the ingredient to the concentration of the selected ingredient in the domain with the highest concentration within the same particle. Thus, $X_{part}$ is represent by the formula:

$$X_{part}=X_{min}/X_{mix}$$

where $X_{min}$ is the concentration of the selected ingredient in the discrete area in the particle with the lowest levels of the selected ingredient and $X_{mix}$ concentration of a selected detergent ingredient in the discrete areas in the particle with the highest levels of the selected ingredient. A discrete volume or domain of the present invention is one in which there is a clear morphological difference between the domains; typically a domain accounts for more than 1%, preferably, 5% of the volume of the particle. For example, a particle that is homogeneous throughout the particle has only one (1) domain. Thus, a particle which has the same concentration throughout such as a spray-dried granule with a active concentration of 25% surfactant, $X_{part}$ would he equal to one (I) or 0.25/0.25 as the particle contains only one domain. However, in a particle, which is agglomerated from two different starting ingredients such as spray-dried granules having 5% active surfactant and dry detergent agglomerates having 50% active surfactant to form mixed agglomerates as defined herein (i.e., where the compositional differences in the starting materials remain clearly evident within the microstructure of the resultant mixed agglomerate), $X_{part}$ would be equal to 0.1 or 0.05/0.5. When a composition contains more than one particulate component, $X_{part}$ is taken as the average of $X_{min}/X_{mix}$ for each component.

The homogeneity number of the present invention is to be calculated on particles which comprise the bulk of the detergent composition. Thus, particles which individually or collectively account for less than about 10% by weight of the finished composition should not be employed in the calculation of homogeneity number. These low level ingredients typically include admix ingredients such for example, .enzymes, bleach ingredients, perfume ingredients, sodium carbonate, sodium sulfate and various other minor additions.

While not wishing to be bound by theory, it is believed that by concentrating certain ingredients and/or selectively separating them, one can prevent the gelling upon dissolution due to chemical interactions between the particles.

The present invention provides a detergent composition that has superior solubility performance and flowability due to the homogeneity profile of the composition. Preferably, the geometric mean particle diameter of the particles is from about 400 microns to about 1500 microns, more preferably from about 500 microns to about 1200 microns, and most preferably from about 600 microns to about 1000 microns. The particle size distribution is defined by a relative tight geometric standard deviation or "span" so as not to have too many particles outside of the target size. Accordingly, the geometric standard deviation is preferably is from about 1 to about 2, more preferably is from about 1.0 to about 1.7, even more preferably is from about 1.0 to about 1.4, and most preferably is from about 1.0 to about 1.2. The average bulk density of the particles is preferably at least about 400 g/l, more preferably at least about 550 g/l, and most preferably at least about 600 g/l.

While not intending to be bound by theory, it is believed that solubility is enhanced as a result of the particles in the detergent composition having the aforementioned homogeneity profile. Specifically, as a result of the particles being more uniform in size, the actual "contact points" among the particles in the detergent composition is reduced which, in turn, reduces the "bridging effect" commonly associated with the "lump-gel" dissolution difficulties of granular detergent compositions. Previous granular detergent compositions contained particles of homogeneity number in the range of from about 0.5 to about 1 and particle diameter sizes which leads to more contact points among the particles. For example, finer particles have more inter-particle contacts per unit volume than do coarser particles, and increasing in the contacts per unit volume increases the per-volume strength of lump-gel formations, thereby increasing the probability of said lump-gel formations persisting through the agitation in the wash cycle and leaving undesired residues on fabrics. The homogeneity number, level and uniform size of the particles in the granular detergent composition of the present invention avoids such problems.

By "a portion" of the particles, it is meant that at least some particles in the detergent composition contain a detersive surfactant and/or a detergent builder to provide the fundamental building blocks of a typical detergent composition. The various surfactants and builders as well as their respective levels in the composition are set forth hereinafter. Typically, the detergent composition will contain from about 1% to about 50% by weight of a detersive surfactant and from about 1% to about 75% by weight of a detergent builder.

Another important attribute of the granular detergent products of this invention is the shape of the individual particles. Shape can be measured in a number of different ways known to those of ordinary skill in the art. One such method is using optical microscopy with Optimus (V5.0) image analysis software. Important calculated parameters are:

"Circularity" which is defined as (measured perimeter length of the particle image)$^2$/(measured area of the particle image). The circularity of a perfectly smooth sphere (minimum circularity) is 12.57; and "Aspect Ratio" which is defined as the length/width of the particle image.

Each of these attributes is important and can be averaged over the bulk granular detergent composition. Further, the combination of the two parameters as defined by the product of the parameters is important as well (i.e. both must be controlled to get a product with good appearance).

Preferably, the granular detergent compositions of this invention have circularity less than about 50, preferably less than about 30, more preferably less than about 23, most preferably less than about 18. Also preferred are granular detergent compositions with aspect ratios less than about 2, preferably less than about 1.5. more preferably less than about 1.3 most preferably less than about 1.2.

Additionally, it is preferred to have a uniform distribution of shapes among the particles in the composition. Specifically, the granular detergent compositions of this invention have a standard deviation of the number distribution of circularity less than about 20, that is preferably less than about 10, more preferably less than about 7 most preferably less than about 4. And the standard deviation of the number distribution of aspect ratios is preferably less than about 1, more preferably less than about 0.5, even more preferably less than about 0.3, most preferably less than about 0.2.

In an especially preferred process of the present invention, granular detergent compositions are produced wherein the product of circularity and aspect ratio is less than about 100, preferably less than about 50, more preferably less than about 30, and most preferably less than about 20. Also preferred are granular detergent compositions with the standard deviation of the number distribution of the product of circularity and aspect ratio of less than about 45, preferably less than about 20, more preferably less than about 7 most preferably less than about 2.

The preferred detergent compositions of this invention meet at least one and most preferably all, of the attribute measurements and standard deviations as defined above, that is for homogeneity number, whiteness, color, uniformity, circularity and aspect ratio.

The present invention also comprises a process for the production of a detergent composition having a superior homogeneity profile. The detergent granules of the present invention comprise at least one detergent active material and are preferably selected from spray-dried detergent granules, wet detergent agglomerates, dry detergent agglomerates and detergent adjunct ingredient or other granules typically incorporated into a detergent composition. The granules may be in particle, agglomerate or flake form.

Detergent adjunct ingredients includes but is not limited to, raw materials such as carbonates, phosphates, sulfates, zeolites., surfactants, bleaches, enzymes, perfumes or the like. Of course, other conventionally known ingredients may be included as well. Spray-dried detergent granules include those particles which are manufactured via a conventional spray-drying technique wherein a slurry of detergent materials is prepared and sprayed downward into a upwardly flowing stream of gas to dry the particles. A dry free flowing material is produced from the process. Wet detergent agglomerates includes those particles that are manufactured via an granulation type process wherein detergent adjunct ingredients such as described above are admixed with a liquid binder material such as surfactant or precursor thereof in a mixer or series of mixer to form granules of detergent materials. These particles are known as "wet agglomerates" until dried and as dry agglomerates upon exiting a drying stage Accordingly, the present invention entails the introduction of both raw materials such as surfactants and builders or the introduction of previously formed detergent granules for continued processing of the granules. In one preferred embodiment of the present invention, the granules of the present invention are agglomerates of a mixture of feed streams such as spray-dried granules, dry agglomerates and optionally detergent adjuncts that are agglomerated in an agglomeration process such as that described below. The preferred agglomerates are herein referred to as mixed agglomerates.

Dry or wet agglomerates of the present invention are typically formed by an agglomeration of a highly viscous surfactant paste or a liquid acid precursor of a surfactant and the aforementioned detergent adjunct ingredients or formed granules such as spray-dried granules agglomerates or detergent adjuncts are described above may be substituted. The agglomeration may be carried out in a high or moderate speed mixer after which an optional low or moderate speed mixer may be employed for further agglomeration, if necessary. Low speed mixers according to the present invention may include Alternatively, the agglomeration may be carried out in a single mixer that can be low, moderate or high speed. The particular mixer used in the present process should include pulverizing or grinding and agglomeration tools so that both techniques can be carried forth simultaneously in a single mixer. To that end, it has been found that the first processing step can be successfully completed, under the process parameters described herein, in a Lodige KM™ (Ploughshare) moderate speed mixer, Lodige CB™ high speed mixer, or mixers made by Fukae, Drais, Schugi or similar brand mixer. The Lodige KM™ (Ploughshare) moderate speed mixer, which is a preferred mixer for use in the present invention, comprises a horizontal, hollow static cylinder having a centrally mounted rotating shaft around which several plough-shaped blades are attached. Preferably, the shaft rotates at a speed of from about 15 rpm to about 140 rpm, more preferably from about 80 rpm to about 120 rpm. The grinding or pulverizing is accomplished by cutters, generally smaller in size than the rotating shaft, which preferably operate at about 3600 rpm. Other mixers similar in nature which are suitable for use in the process include the Lodige Ploughshare™ mixer and the Drais® K-T 160 mixer. Generally. in the process of the present invention, the shear will be no greater than the shear produced by a Lodige KM mixer with a tip speed of the ploughs below 30 m/s or even below 10 m/s or even lower.

Preferably, the mean residence time of the various detergent ingredients in the low, moderate or high speed mixer is preferably in range from about 0.1 seconds to about 30 minutes, most preferably the residence time is about 0.5 to about 5 minutes. In this way, the density of the resulting detergent agglomerates is at the desired level.

This agglomeration is typically followed by a drying step. This drying step may be carried out in a wide variety of equipment including, but not limited to a fluid bed drying apparatus. Examples of dryer characteristics include fixed or vibrating; rectangular bed or round bed; and straight or serpentine dryers. Manufacturers of such dryers include Niro, Bepex, Spray Systems and Glatt. By way of example, an apparatus such as a fluidized bed can be used for drying while an airlift can be used for cooling should it be necessary. The air lift can also be used to force out the "fine" particles so that they can be recycled to the particle agglomeration process.

The agglomeration may comprise the step of spraying an additional binder in the mixers or fluid bed to facilitate production of the desired detergent particles. A binder is added for purposes of enhancing agglomeration by providing a "binding" or "sticking" agent for the detergent components. The binder is preferably selected from the group consisting of water, anionic surfactants, nonionic surfactants, polyethylene glycol, polyvinyl pyrrolidone, acetates, polyacrylates, citric acid and mixtures thereof. Other suitable binder materials including those listed herein are described in Beerse et al, U.S. Pat. No. 5,108,646 (Procter & Gamble Co.), the disclosure of which is incorporated herein by reference.

Another optional processing step to form the particles of the present invention includes continuously adding a coating agent such as zeolites, recycled "fines" as described above and fumed silica to the mixer to improve the particle color, increase the particle "whiteness or facilitate free flowability of the resulting detergent particles and to prevent over agglomeration. When employing recycled fines as the coating agent, the fines are preferably in the approximate size range of 0.01 to 0.5 times the mean particle size of the larger particles. The granule coating will also improve the integrity of the fines layering and provide abrasion and attrition resistance during handling. In addition, the detergent starting materials can be fed into a pre-mixer, such as a Lodige CB mixer or a twin-screw extruder, prior to entering in the mixer. This step, although optional, does indeed facilitate agglomeration.

Also particularly preferred in the present invention are spray-dried detergent granules which comprise tower blown particles. In this process, the granules are formed by the preparation of a slurry of surfactant materials, water and detergent adjunct ingredients materials. The resultant slurry is then passed to a tower where the slurry is sprayed into a stream of air at temperatures typically ranging from about 175° C. to about 375° C. to dry the detergent slurry and formed detergent particles. Typically, resultant densities of these particles. range from about 200 to about 600 g/l.

The particles of the present invention comprise at least about 50% by weight of particles having a geometric mean particle diameter of from about 500 microns to about 1500 microns and preferably have a geometric standard deviation of from about 1 to about 2. Preferably the geometric standard deviation is from about 1.0 to about 1.7, preferably from about 1.0 to about 1.4. The granular detergent composition resulting from the processes may comprise undersized or fine particles, wherein "fine particles" are defined as particles that have a geometric mean particle diameter that is less than about 1.65 standard deviations below the chosen geometric mean particle diameter of the granular detergent composition at a given span or geometric standard deviation. Oversized or large particles may also exist wherein "large particles" are defined as particles that have a geometric mean particle diameter that is greater than about 1.65 standard deviations above the chosen geometric mean particle diameter of the granular detergent composition at a given span or geometric standard deviation. The fine particles are preferably separated from the granular detergent composition and returned to the process by adding them to at least one of the mixers and/or the fluid bed dryer as described in detail below. Likewise, the large particles are preferably separated from the granular detergent composition and then fed to a grinder where their geometric mean particle diameter is reduced. After the geometric mean particle diameter of the large particles is reduced, the large particles are returned to the process by adding them to at least one of the mixers and/or the fluid bed dryer.

In preferred processing of the present invention, the granules of the present invention are produced in a fluidized bed via the combination of spray-dried granules, adjunct ingredients and dry agglomerates. A liquid binder material such as silicates, polyethylene glycols, surfactants and precursors thereof and various other materials may be added to the fluid bed to enhance agglomeration. Optionally, the feed materials are passed through a pre-mixer or series of mixers such as a moderate speed mixer as described above.

The fluidized bed is preferably operated such that the flux number FN of the fluid bed is al least about 2.5 to about 4.5. Flux number ($FN_m$) is a ratio of the excess velocity ($U_e$) of the fluidisation gas and the particle density ($p_p$) relative to the mass flux ($q_{liq}$) of the liquid sprayed into the bed at a normalized distance ($D_o$) of the spraying device. The flux number provides and estimation of the operating parameters of a fluidized bed to control granulation within the bed. The flux number may be expressed either as the mass flux as determined by the following formula:

$$FN_m=\log_{10}[\{p_p U_c\}/q_{liq}]$$

or as the volume flux as determined by the formula:

$$FN_v=\log_{10}[\{U_c\}/q_{liq}]$$

where $q_{vlig}$ is the volume of spray into the fluid bed. Calculation of the flux number and a description of its usefulness is fully described in WO 98/58046 the disclosure of which is herein incorporated by reference.

In addition, the fluidized bed is operated at a Stokes number of less than about 1, more preferably from about 0.1 to about 0.5. The Stokes number is a measure of particle coalescence for describing the degree of mixing occurring to particles in a piece of equipment such as the fluid bed. The Stokes number is measured by the formula:

$$\text{Stokes number}=4pvd/9u$$

wherein p is the apparent apparent particle density, v is the excess velocity, d is the mean particle diameter and u is the viscosity of the binder. The Stokes number and a description of its usefulness is described in detail in WO 99/03964, the disclosure of which is herein incorporated by reference.

The granules of the present invention are passed into a fluid bed dryer having multiple internal "stages" or "zones". A stage or zone is any discrete area within the dryer, and these terms are used interchangeably herein. The process conditions within a stage may be different or similar to the other stages in the dryer. It is understood that two adjacent dryers are equivalent to a single dryer having multiple stages. The various feed streams of granules and coating material can be added at the different stages, depending on, for example, the particle size and moisture level of the feed stream. Feeding different streams to different stages can minimize the heat load on the dryer, and optimize the particle size and shape as defined herein.

Typically, the fluid bed mixer of the present invention comprises a first spraying zone where the binder material is applied. The spraying zone involves the spraying of the binder in aqueous or slurry form onto the fluidized particles. The bed is typically fluidized with heated air in order to dry or partially dry moisture from the spray as it is applied. The spraying is achieved via nozzles capable of delivering a fine or atomized spray of the coating mixture to achieve complete coverage of the particles. Typically, the droplet size from the atomizer is less than about 2 times the particle size. This atomization can be achieved either through a conventional two-fluid nozzle with atomizing air, or alternatively by means of a conventional pressure nozzle. To achieve this type of atomization, the solution or slurry rheology is typically characterized by a viscosity of less than about 500 centipoise, preferably less than about 200 centipoise at the point of atomization. While the nozzle location in the fluid bed may be in most any location, the preferred location is a positioning that allows a vertical down spray of the coating mixture such as a top spray configuration. To achieve best results, the nozzle location is placed at or above the fluidized height of the particles in the fluid bed. The fluidized height is typically determined by a weir or overflow gate height. The coating zone of the fluid bed is then typically followed by a drying zone and a cooling zone. Of course, one of ordinary skill in the art will recognize that alternative arrangements are also possible to achieve the resultant coated particles of the present invention.

Typical conditions within a fluid bed apparatus of the present invention include (i) from about 1 to about 20 minutes of mean residence time, (ii) from about 100 to about 600 mm of depth of unfluidized bed, (iii) a droplet size of 2 times the particle size, preferably not more than about 100 micron more preferably not more than 50 micron, (iv) from about 150 to about 1600 mm of spray height from the fluid bed plate or preferably 0–600 mm from the top of the fluid bed, (v) from about 0.1 to about 4.0 m/s of fluidizing velocity, preferably about 1.0 to 3.0 m/s and (vi) from about 12 to about 200° C. of bed temperature. preferably about 15 to about 100° C. Once again, one of ordinary skill in the art will recognize that the conditions in the fluid bed may vary depending on a number of factors.

The coated granules exiting the coating mixer may comprise in and of themselves a fully formulated detergent composition or in preferred embodiments may be admixed with additional ingredients, such as bleaching agents, enzymes, perfumes, non-coated detergent particles, and various other ingredients to produce a fully formulated detergent corn position.

DETERGENT COMPONENTS

The surfactant system of the detergent composition may include anionic, nonionic, zwitterionic, ampholytic and cationic classes and compatible mixtures thereof. Detergent surfactants are described in U.S. Pat. No. 3,664,961, Norris, issued May 23, 1972, and in U.S. Pat. No. 3,919,678, Laughlin et al., issued Dec. 30, 1975, both of which are incorporated herein by reference. Cationic surfactants include those described in U.S. Pat. No. 4,222,905, Cockrell, issued Sep. 16, 1980, and in U.S. Pat. No. 4,239,659, Murphy, issued Dec. 16, 1980, both of which are also incorporated herein by reference.

Nonlimiting examples of surfactant systems include the conventional $C_{11}$–$C_{18}$ alkyl benzene sulfonates ("LAS") and primary, branched-chain and random $C_{10}$–$C_{20}$ alkyl sulfates ("AS"), the $C_{10}$–$C_{18}$ secondary (2,3) alkyl sulfates of the formula $CH_3(CH_2)_x(CHOSO_3^-M^+)$ $CH_3$ and $CH_3(CH_2)_y(CHOSO_3^-M^+)CH_2CH_3$ where x and (y+1) are integers of at least about 7, preferably at least about 9, and M is a water-solubilizing cation, especially sodium, unsaturated sulfates such as oleyl sulfate, the $C_{10}$–$C_{18}$ alkyl alkoxy sulfates ("$AE_xS$"; especially EO 1–7 ethoxy sulfates), $C_{10}$–$C_{18}$ alkyl alkoxy carboxylates (especially the EO 1–5 ethoxycarboxylates), the $C_{10-18}$ glycerol ethers, the $C_{10}$–$C_{18}$ alkyl polyglycosides and their corresponding sulfated polyglycosides, and $C_{12}$–$C_{18}$ alpha-sulfonated fatty acid esters. If desired, the conventional nonionic and amphoteric surfactants such as the $C_{12}$–$C_{18}$ alkyl ethoxylates ("AE") including the so-called narrow peaked alkyl ethoxylates and $C_6$–$C_{12}$ alkyl phenol alkoxylates (especially ethoxylates and mixed ethoxy/propoxy), $C_{12}$–$C_{18}$ betaines and sulfobetaines ("sultaines"), $C_{10}$–$C_{18}$ amine oxides, and the like, can also be included in the surfactant system. The $C_{10}$–$C_{18}$ N-alkyl polyhydroxy fatty acid amides can also be used. Typical examples include the $C_{12}$–$C_{18}$ N-methylglucamine. See WO 9,206,154. Other sugar-derived surfactants include the N-alkoxy polyhydroxy fatty acid amides, such as $C_{10}$–$C_{18}$ N-(3-methoxypropyl) glucamide. The N-propyl through N-hexyl $C_{12}$–$C_{18}$glucamides can be used for low sudsing. $C_{10}$–$C_{20}$ conventional soaps may also be used. If high sudsing is desired, the branched-chain $C_{10}$–$C_{16}$ soaps may be used. Mixtures of anionic and nonionic surfactants are especially useful. Other conventional useful surfactants are listed in standard texts.

The detergent composition can, and preferably does, include a detergent builder. Builders are generally selected from the various water-soluble, alkali metal, ammonium or substituted ammonium phosphates, polyphosphates, phosphonates, polyphosphonates, carbonates, silicates, borates, polyhydroxy sulfonates, polyacetates, carboxylates, and polycarboxylates. Preferred are the alkali metal, especially sodium, salts of the above. Preferred for use herein are the phosphates, carbonates, silicates, $C_{10-18}$ fatty acids, polycarboxylates, and mixtures thereof. More preferred are sodium tripolyphosphate, tetrasodium pyrophosphate, citrate, tartrate mono and di-succinates, sodium silicate, and mixtures thereof (see below).

Specific examples of inorganic phosphate builders are sodium and potassium tripolyphosphate, pyrophosphate, polymeric metaphosphate having a degree of polymerization of from about 6 to 21, and orthophosphates. Examples of polyphosphonate builders are the sodium and potassium salts of ethylene diphosphonic acid, the sodium and potassium salts of ethane 1-hydroxy-1,1-diphosphonic acid and the sodium and potassium salts of ethane, 1,1,2-triphosphonic acid. Other phosphorus builder compounds are disclosed in U.S. Pat. Nos. 3,159,581; 3,213,030; 3,422,021; 3,422,137; 3,400,176 and 3,400,148, all of which are incorporated herein by reference.

Examples of nonphosphorus, inorganic builders are sodium and potassium carbonate, bicarbonate, sesquicarbonate, tetraborate decahydrate, and silicates having a weight ratio of $SiO_2$ to alkali metal oxide of from about 0.5 to about 4.0, preferably from about 1.0 to about 2.4. Water-soluble, nonphosphorus organic builders useful herein include the various alkali metal, ammonium and substituted ammonium polyacetates, carboxylates, polycarboxylates and polyhydroxy sulfonates. Examples of polyacetate and polycarboxylate builders are the sodium, potassium, lithium, ammonium and substituted ammonium salts of ethylene diamine tetraacetic acid, nitrilotriacetic acid, oxydisuccinic acid, mellitic acid, benzene polycarboxylic acids, and citric acid.

Polymeric polycarboxylate builders are set forth in U.S. Pat. No. 3,308,067. Diehl, issued Mar. 7, 1967, the disclosure of which is incorporated herein by reference. Such materials include the water-soluble salts of homo- and copolymers of aliphatic carboxylic acids such as maleic acid, itaconic acid, mesaconic acid, fumaric acid, aconitic acid. citraconic acid and methylenemalonic acid. Some of these materials are useful as the water-soluble anionic polymer as hereinafter described, but only if in intimate admixture with the nonsoap anionic surfactant.

Other suitable polycarboxylates for use herein are the polyacetal carboxylates described in U.S. Pat. No. 4,144,226, issued Mar. 13, 1979 to Crutchfield et al., and U.S. Pat. No. 4,246,495, issued Mar. 27, 1979 to Crutchfield et al., both of which are incorporated herein by reference. These polyacetal carboxylates can be prepared by bringing together under polymerization conditions an ester of glyoxylic acid and a polymerization initiator. The resulting polyacetal carboxylate ester is then attached to chemically stable end groups to stabilize the polyacetal carboxylate against rapid depolymerization in alkaline solution, converted to the corresponding salt, and added to a detergent composition. Particularly preferred polycarboxylate builders are the ether carboxylate builder compositions comprising a combination of tartrate monosuccinate and tartrate disuccinate described in U.S. Pat. No. 4,663,071, Bush et al., issued May 5, 1987, the disclosure of which is incorporated herein by reference.

Water-soluble silicate solids represented by the formula $SiO_2.M_2O$, M being an alkali metal, and having a $SiO_2$:$M_2O$ weight ratio of from about 0.5 to about 4.0, are useful salts in the detergent granules of the invention at levels of from about 2% to about 15% on an anhydrous weight basis, preferably from about 3% to about 8%. Anhydrous or hydrated particulate silicate can be utilized, as well.

Any number of additional ingredients can also be included as components in the granular detergent composition. These include other detergency builders, bleaches. bleach activators, suds boosters or suds suppressors, anti-tarnish and anti-corrosion agents, soil suspending agents, soil release agents, germicides, pH adjusting agents, non-builder alkalinity sources, chelating agents, smectite clays, enzymes, enzyme-stabilizing agents and perfumes. See U.S. Pat. No. 3,936,537, issued Feb. 3, 1976 to Baskerville, Jr. et al., incorporated herein by reference.

Bleaching agents and activators are described in U.S. Pat. No. 4,412,934, Chung et al., issued Nov. 1, 1983, and in U.S. Pat. No. 4,483,781, Hartman, issued Nov. 20, 1984, both of which are incorporated herein by reference. Chelating agents are also described in U.S. Pat. No. 4,663,071, Bush et al., from Column 17, line 54 through Column 18, line 68, incorporated herein by reference. Suds modifiers are also optional ingredients and are described in U.S. Pat. No. 3,933,672, issued Jan. 20, 1976 to Bartoletta et al., and U.S. Pat. No. 4,136,045, issued Jan. 23, 1979 to Gault et al., both incorporated herein by reference.

Suitable smectite clays for use herein are described in U.S. Pat. No. 4,762,645, Tucker et al., issued Aug. 9, 1988, Column 6, line 3 through Column 7, line 24, incorporated herein by reference. Suitable additional detergency builders for use herein are enumerated in the Baskerville patent, Column 13, line 54 through Column 16, line 16, and in U.S. Pat. No. 4,663,071, Bush et al., issued May 5, 1987, both incorporated herein by reference.

The following examples are presented for illustrative purposes only and are not to be construed as limiting the scope of the appended claims in any way.

EXAMPLE I

A finished detergent composition is produced dry blending or admixing two feed streams. The first is a 20% by weight surfactant active spray-dried granules. The second is a 30% surfactant active agglomerated granule. The two particles are mixed at 50 weight % each. The homogeneity number of the finished detergent is 0.67 as calculated from $X_{bulk}$=0.2/0.3=0.67 and $X_{part}$=(0.2/0.2)+(0.3/0.3)/2=1

EXAMPLE II

A detergent composition is produced in a batch process in a fluidized bed having a depth of 6 inches and a batch weight of 1500 g. The inlet temperature of the bed was 130° C. the bed temperature was 45° C. and the air velocity was 1 m/s. The feed comprises 50% dry agglomerates having a surfactant active concentration of 50% and 50% spray-dried granules having a surfactant active concentration of 5%. A total of 250 grams of a 30 wt % solution of PEG 4000 was sprayed into the fluidized bed to agglomerate the feed ingredients into a mixed agglomerate. The final composition has a median particle size of ~600 um, and a homogeneity number of 10 as calculated from $X_{bulk}$=1 from $X_{min}$(0.275)/$X_{max}$(0.275)=1 and $X_{part}$=0.1 from $X_{min}$(0.05)/$X_{max}$(0.5).

EXAMPLE III

A detergent composition is produced by dry blending the feed streams of Example II without agglomeration of the two streams. The finished composition has a homogeneity number of 0.1 as calculated from $X_{bulk}$=0.05/0.5=0.1 and $X_{part}$=(0.05/0.05+0.5/0.5)/2=1.

Having thus described the invention in detail, it will be obvious to those skilled in the art that various changes may be made without departing from the scope of the invention and the invention is not to be considered limited to what is described in the specification.

What is claimed is:

1. A granular detergent composition having a homogeneity number, HN, as defined by the equation:

$$HN=X_{bulk}/X_{part}$$

where $X_{bulk}$ is the ratio of the concentration of a surfactant in the particle with the lowest level of said surfactant to the concentration of said surfactant in the particle with the highest level of said surfactant and $X_{part}$ is the ratio of the concentration of a discrete volume of a particle with the lowest level of said surfactant to the concentration of the discrete volume of the same particle with the highest level of said surfactant, of less than 0.5 or greater than 1, said composition having a particle circularity of less than 23, with an aspect ratio less than 2 and a product of the circularity times the aspect ratio of less than 30.

2. The detergent composition as claimed in claim 1 wherein said homogeneity number is greater than 1.25.

3. The detergent composition as claimed in claim 1 wherein at least about 50% by weight of particles have a geometric mean particle diameter of from about 400 microns to about 1500 microns with a geometric standard deviation of from about 1 to about 2, wherein at least a portion of said particles contain said surfactant and a detergent builder.

4. The granular detergent composition of claim 3 wherein said particles comprise at least about 75% by weight of said detergent composition.

5. The granular detergent composition of claim 3 wherein the geometric standard deviation is from about 1.0 to about 1.7.

6. The granular detergent composition of claim 3 wherein said particles comprise at least about 90% by weight of said detergent composition.

* * * * *